US009512710B2

(12) United States Patent
Mason et al.

(10) Patent No.: US 9,512,710 B2
(45) Date of Patent: Dec. 6, 2016

(54) IDENTIFYING FORCES IN A WELL BORE

(71) Applicant: BP Exploration Operating Company Limited, Middlesex (GB)

(72) Inventors: Colin James Mason, Addlestone (GB); Edward James Streeter, Dunsford (GB)

(73) Assignee: BP EXPLORATION OPERATING COMPANY LIMITED, Middlesex (GB)

( * ) Notice: Subject to any disclaimer, the term of this patent is extended or adjusted under 35 U.S.C. 154(b) by 223 days.

(21) Appl. No.: 14/352,374

(22) PCT Filed: Oct. 19, 2012

(86) PCT No.: PCT/EP2012/070750

§ 371 (c)(1),
(2) Date: Apr. 17, 2014

(87) PCT Pub. No.: WO2013/057247

PCT Pub. Date: Apr. 25, 2013

(65) Prior Publication Data

US 2014/0260592 A1 Sep. 18, 2014

Related U.S. Application Data

(63) Continuation of application No. PCT/GB2011/001505, filed on Oct. 19, 2011.

(30) Foreign Application Priority Data

Oct. 19, 2011 (WO) ..... PCT/GB2011/001505

(51) Int. Cl.
*E21B 44/00* (2006.01)
*G01V 1/40* (2006.01)
(Continued)

(52) U.S. Cl.
CPC ..... *E21B 47/0006* (2013.01); *E21B 44/00* (2013.01); *E21B 47/00* (2013.01)

(58) Field of Classification Search
None
See application file for complete search history.

(56) References Cited

U.S. PATENT DOCUMENTS 2,851,880 A 9/1958 Fiedler
4,139,891 A * 2/1979 Sheldon ..... E21B 19/08 340/666
(Continued)

FOREIGN PATENT DOCUMENTS

EP 0148003 A1 7/1985
EP 0274207 A1 7/1988
WO 2010/102110 A2 9/2010

OTHER PUBLICATIONS

PCT/EP2012/070750 International Preliminary Report on Patentability dated May 1, 2014 (500018 2) (11 p.).
(Continued)

*Primary Examiner* — Andre Allen
*Assistant Examiner* — Jermaine Jenkins
(74) *Attorney, Agent, or Firm* — Conley Rose, P.C.

(57) ABSTRACT

A member is moved within a well bore in a plurality of cycles, each cycle including holding the member in slips, releasing the slips, moving the member within the well bore and applying the slips. The hook load is measured at multiple points during each of these cycles and the plurality of measured values are used to identify data indicative of the forces on the member within the well bore.

21 Claims, 12 Drawing Sheets

(51) Int. Cl.
*G01V 3/18* (2006.01)
*E21B 47/00* (2012.01)

(56) References Cited

U.S. PATENT DOCUMENTS 4,450,906 A 5/1984 Firmin
6,267,185 B1 * 7/2001 Mougel ..... E21B 47/12 175/45
6,637,526 B2 * 10/2003 Juhasz ..... E21B 19/00 166/77.51
6,691,801 B2 * 2/2004 Juhasz ..... E21B 19/00 166/53
7,108,057 B2 * 9/2006 Baird ..... E21B 19/10 166/77.51
7,395,855 B2 * 7/2008 Ayling ..... E21B 19/10 166/75.14
7,513,167 B1 4/2009 Serata
7,831,419 B2 * 11/2010 Cariveau ..... E21B 10/00 175/336
8,272,456 B2 * 9/2012 Zupanick ..... E21B 3/02 175/205
8,281,878 B2 * 10/2012 Eriksen ..... E21B 7/20 166/177.4
9,206,657 B2 * 12/2015 Kuttel ..... E21B 41/0021
2004/0118199 A1 6/2004 Frost et al.
2008/0264648 A1 10/2008 Pietras et al.
2010/0018701 A1 1/2010 Peter et al.
2010/0228834 A1 9/2010 Hung et al.
2010/0282512 A1 * 11/2010 Rasmus ..... E21B 47/024 175/45

OTHER PUBLICATIONS

PCT/EP2012/070750 International Search Report and Written Opinion dated Apr. 19, 2013 (500018 2)(16 p.).

* cited by examiner

IDENTIFYING FORCES IN A WELL BORE

CROSS-REFERENCE TO RELATED APPLICATIONS

This application is a 35 U.S.C. §371 national stage application of PCT/EP2012/070750 filed Oct. 19, 2012 and entitled "Identifying Forces in a Well Bore," which claims priority to PCT/GB2011/001505 filed Oct. 19, 2011 and entitled "Identifying Friction in a Well Bore," both of which are hereby incorporated herein by reference in their entirety for all purposes.

FIELD OF THE INVENTION

The present invention relates to systems and methods for identifying forces on a member being moved within a well bore, and in particular for identifying such forces from surface measurements measured by a rig to which the member is attached. The present invention is particularly suited for employment when the member is a tubular member, for example, a casing string, liner string or a tubing string such as a drill string, injection tubing string, or a production tubing string.

BACKGROUND

During and after the drilling of a well bore, tubular members are lowered into or raised out of the well bore. In one exemplary case, the tubular member is a casing string, which is usually a tubular steel pipe which serves to line the well bore and therefore to isolate the rock formations surrounding the well bore from the fluids passing along the well bore. The process of lowering the casing string into a well bore is usually known as running the casing string.

A casing string (or other tubular member within a well bore) generally consists of multiple sections or 'joints' of a standardized length, typically 12 meters (40 feet). The process of moving the casing string therefore proceeds in a number of repeated cycles, each cycle comprising adding or removing a joint to/from the upper end of the existing casing string and then moving the casing string within the well bore such that the process can be repeated. This process will be described, as part of an embodiment, in more detail below with reference to FIGS. 2*a* to 2*d*.

While the casing string is being moved, it is attached to a moveable unit, typically referred to as a 'hook'. The hook can be raised and lowered by a rig so as to move the casing string within the well bore. The hook, or equipment attached thereto, is capable of measuring the 'hook load', which is the total force on the hook. This force is dependent on the weight of the casing string (including collars and other ancillary equipment), accounting for any forces on the casing string caused by, for example, friction between the casing string and the well bore wall, buoyant forces on the casing string caused by its immersion in fluids, viscous drag caused by displaced fluid, and any pressure in the wellbore acting on the cross-sectional area of the casing string.

Traditionally, the hook load is measured so as to track the progress of the running of the casing string. One measurement of hook load is taken for each lowering cycle. This measurement is typically a steady state measurement performed 'by eye'; that is, a human operator on the rig looks for a steady state in the hook load during the lowering of the casing string and records this as the hook load for that cycle. As the operator looks for a steady state during the lowering of the casing string, this measure of hook load may be used to calculate a measure of the dynamic friction (also known as kinetic friction) present between the casing string and the well bore. The measured hook-load value may be known in the art as the tripping-in weight.

A casing string (or other tubular member), being moved within a well bore may become stuck such that it can no longer be moved (either rotated or moved axially, up or down). Such situations, often known as 'stuck casing' or 'stuck pipe', are generally caused by excessive static friction along the well bore. One particular cause of a 'stuck pipe' is "differential sticking", which is a situation where a tubular member is pressed against the side of a well bore so that it contacts the side of the well bore along a substantial length of the tubular member; however other causes of a stuck pipe are well bore collapse or some form of instability in the well bore.

A stuck pipe is one of the greatest problems involved with drilling a well bore, and can result in many days of lost productivity, result in losses to equipment (because the casing string or other tubular member cannot be recovered), and can reduce the output of a resultant well (due to narrower bore tubing having to be run down the stuck tubing).

As is known, static friction is the measure of friction between two surfaces that are stationary with relation to one another. By contrast, dynamic friction is a measure of the friction between two surfaces which are moving relative to each other. The causes of static and dynamic friction within a well bore are different, and consequently, the magnitudes of the friction forces in each case are different, with static friction generally being the greater.

Therefore, it has been found that the measures of hook load, and therefore measures of dynamic friction as described above, are unable to identify the magnitude or nature of static friction in a well bore.

It is an object of the embodiments to identify the magnitude and nature of friction between the well bore and a tubular member within it, and consequently to enable a more effective forecasting of a stuck tubular member (stuck pipe), as well as facilitating the diagnosis of well bore conditions which might lead to a stuck tubular member.

A further problem which may occur when moving a member in a well bore, either to run-in or pull out the member, is that the movement of the member causes a downhole pressure wave. This pressure wave may cause damage to the formation, and may cause fluid to leak out of or be drawn into the formation. Therefore a further object of embodiments is to enable the effects of the movement of fluid downhole to be detected.

SUMMARY OF THE INVENTION

In accordance with at least one embodiment, methods, devices, systems and software are provided for supporting or implementing functionality to provide for the identification of a spatial relationship between a first and a second frame of reference, as specified in the independent claims. This is achieved by a combination of features recited in each independent claim. Accordingly, dependent claims prescribe further detailed implementations.

According to a first aspect there is provided a system for identifying a force on a member being moved within a well bore by a rig, the rig comprising a moveable unit to which the member is attached so as to be moved within the well bore, and slips for holding the member, wherein the member is moved in a plurality of cycles, each cycle comprising, in sequence, holding the member in the slips, releasing the slips such that the member moves within the well bore, and applying the slips such that the member is again held by the slips, and the rig comprises a measurement unit arranged to measure a force imparted by the member onto the moveable unit, and being arranged to output first data indicative of a plurality of load values, each data item of said first data being indicative of a said force measured at each of a plurality of points during a said cycle, the system comprising: an interface arranged to receive data from the measurement unit; and a data processing system arranged, for each of a plurality of said cycles to: identify a plurality of said load values from the received data, each load value corresponding to a different point in time in respect of the cycle, and determine second data indicative of the friction between the well bore and the member from the identified plurality of load values.

The member that is moved within the wellbore may be a tubular member, for example, a casing string, a liner string, a tubing string such as a production tubing or injection tubing, or a drill string. Where the tubular member is a casing string, the wellbore may be open hole. Where the tubular member is, for example, an injection tubing string or a production tubing string, the wellbore may have been previously lined with a casing string or some other form of liner string.

The average hook load during a cycle is typically the combination of the weight of the member and dynamic friction between the member and the well bore. Consequently the average hook load itself does not given an indication of the other forces on the member, such as static friction between the member and the well bore which is present before the member begins to move within the well bore, and viscous drag forces caused by the displacement of fluids in the wellbore. Therefore, by identifying a plurality of the load values of a given cycle, and by determining the second data indicative of a force from the identified plurality of load values (i.e. those during a given cycle) the system is able to identify the force on the member by looking at the variations in, and development of, the load values over the cycle.

The data processing system may be arranged to identify a monotonic change in the plurality of values over the cycle, and to determine a magnitude of the monotonic change whereby to determine the second data. The data processing system may be arranged to identify a linear trend in the plurality of values, and to determine a difference between a value of the trend at the beginning of the cycle and a value of the trend at an end of the cycle whereby to determine the second data. In some embodiments, the data processing system may be arranged to identify a linear trend in the plurality of values and to determine a gradient of the trend whereby to determine the second data. In these cases, the second data may be indicative of a viscous drag force on the member as it is moved within the well bore.

Viscous drag forces are caused by the displacement of fluid in the well. The displaced fluid opposes any movement of the member, and thereby varies the force on the moveable unit. Viscous drag forces tend to build up during a given cycle, therefore by looking at the variation of the load values during a given cycle, in particular by looking for a monotonic change in the values, a measure of the viscous drag can be made. From this measure, the likelihood of, for example fracturing in the well bore caused by the fluid movement, can be established and the movement of the member can be adjusted accordingly (i.e. reducing or increasing the speed of movement).

In some embodiments, the data processing system is arranged to: determine said second data for a plurality of said cycles; and determine, using said second data, whether friction between the well bore and the member is increasing. Alternatively or additionally, the data processing system may be arranged to determine a trend in the second data whereby to determine whether friction between the well bore and the member is increasing. In some embodiments, the data processing system is arranged to calculate a risk value indicative of the probability of the member becoming stuck in the well bore from said second data.

One cycle may provide an erroneous result, or equally, static friction may be high during one cycle, but as it is overcome, the cause is removed and the static friction does not reoccur. Consequently, to provide accurate results, it is a benefit that multiple cycles can be compared to discover trends in the data. These trends can be used to identify a developing cause of static friction and therefore a high risk of the member becoming stuck.

The data processing system may be arranged to determine a variation of the plurality of load values whereby to determine said second data. Alternatively the data processing system may be arranged to compare said plurality of load values to a predicted load value whereby to determine said second data. Alternatively the data processing system may be arranged to identify an average value from said plurality of load values and a minimum value from said plurality of load values, and to compare said average value and said minimum value whereby to determine said second data. As such, the data processing system may be arranged to calculate at least one of a mean value, a weighted mean value, a modal class, a median value, or a steady state value whereby to determine said average value.

The system may identify friction in a number of ways. In general this is done by looking at the variation in the load values, a high variation, in particular a low initial value followed by a sharp rise during the cycle being indicative of static friction being overcome. The difference between a low value (when static friction is supporting the casing string) and an average load value may be used to derive a measure of the static friction. However, alternatives, such as looking at the magnitude of oscillations in the load values are possible.

In some embodiments the data processing system is arranged to: identify a period of time in the loading cycle, the period being between the slips being released and the slips being applied; and identify a set of said load values corresponding to points in time during said identified period of time whereby to identify said plurality of said load values.

Optionally, the data processing system is arranged to detect a change in the load values between a level indicative of the member being held in the slips, and a level indicative of the member being supported by the moveable unit, whereby to identify said period of time.

It is advantageous to correctly identify the period in which the load values are truly representative of the weight of and friction on the moveable unit. Therefore by identifying the period described above, errors associated with the transfer of load from the moveable unit to the slips and vice versa can be avoided.

The data processing system may be arranged to compare the load values to a threshold value whereby to detect said change. The data processing system may be arranged to identify said period of time to begin a predetermined duration after a detected change. The data processing system may be arranged to identify said period of time to end a predetermined duration before a detected change.

The data processing system may be arranged to detect at least one oscillation in the load values associated with the slips being released or applied whereby to identify the period of time.

The data processing system may be arranged to receive position data indicative of a position of the moveable unit at said points in time; and wherein the data processing system is arranged to determine the position of the moveable unit using said position data whereby to identify the period of time. The data processing system may be arranged to determine if the moveable unit is between a first and a second position whereby to identify the period of time. The data processing system may be arranged to determine if the moveable unit is in motion whereby to identify the period of time.

The data processing system may be arranged to receive operating mode data indicative of whether the slips are applied or released, and wherein the data processing system is arranged to use said operating mode data to identify the period of time.

While load values alone may be used to identify the period described above, it is possible to use data from other sources to ensure an accurate detection of the period. For example, the moveable unit will move between a first point (at which movable unit is attached to the member and the slips are first released) and a second point (at which the slips are reapplied and the moveable unit is detached from the member). If the moveable unit is between these two points, then it is likely to be during the period of the lowering cycle which is to be identified. Consequently, the position data is indicative of whether the member is moving. Alternatively, the system may look for the moveable unit being inmotion, from the position data to detect this period. Equally the slips are applied at the beginning and end of a cycle; consequently if the slips have been released then the member will likely be attached to, and being moved by, the moveable unit.

According to a further aspect there is provided a method for identifying friction between a well bore and a member within said well bore, the rig comprising a moveable unit to which the member is attached so as to be moved within the well bore, and slips for holding the member, wherein the member is moved in a plurality of cycles, each cycle comprising holding the member in the slips, releasing the slips such that the member moves within the well bore, and applying the slips such that the member is again held by the slips, and the rig comprises a measurement unit arranged to measure a force imparted by the member onto the moveable unit, and being arranged to output first data indicative of a plurality of load values, each data item of said first data being indicative of a said force measured at each of a plurality of points during a said cycle, the method comprising: receiving data from the measurement unit; and for each of a plurality of said cycles: identifying a plurality of said load values from the received data, each load value corresponding to a different point in time in respect of the cycle, and determining second data indicative of the friction between the well bore and the member from the identified plurality of load values.

According to a yet further aspect there is provided a computer readable storage medium storing computer readable instructions thereon for execution on a computing system to implement a method for identifying friction between a well bore and a member within said well bore, the rig comprising a moveable unit to which the member is attached so as to be moved within the well bore, and slips for holding the member, wherein the member is moved in a plurality of cycles, each cycle comprising holding the member in the slips, releasing the slips such that the member into moves within the well bore, and applying the slips such that the member is again held by the slips, and the rig comprises a measurement unit arranged to measure a force imparted by the member onto the moveable unit, and being arranged to output first data indicative of a plurality of load values, each data item of said first data being indicative of a said force measured at each of a plurality of points during a said cycle, the method comprising: receiving data from the measurement unit; and for each of a plurality of said cycles: identifying a plurality of said load values from the received data, each load value corresponding to a different point in time in respect of the cycle, and determining second data indicative of the friction between the well bore and the member from the identified plurality of load values.

Further features and advantages will become apparent from the following description of preferred embodiments, given by way of example only, which is made with reference to the accompanying drawings.

BRIEF DESCRIPTION OF THE DRAWINGS

A drilling rig system will now be described as an embodiment, by way of example only, with reference to the accompanying figures in which.

Several parts and components of these embodiments appear in more than one Figure; for the sake of clarity the same reference numeral will be used to refer to the same part and component in all of the Figures.

DETAILED DESCRIPTION OF ILLUSTRATIVE EMBODIMENTS

Figure 1B:
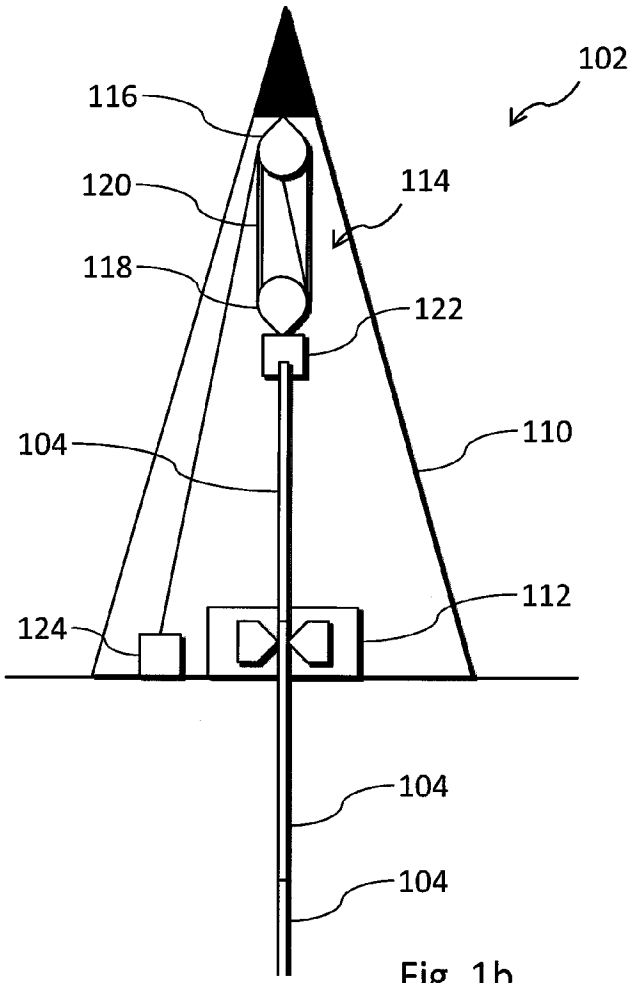
FIG. 1*b* shows a schematic diagram of the components of the drilling rig shown in FIG. 1*a;*
Figure 1A:
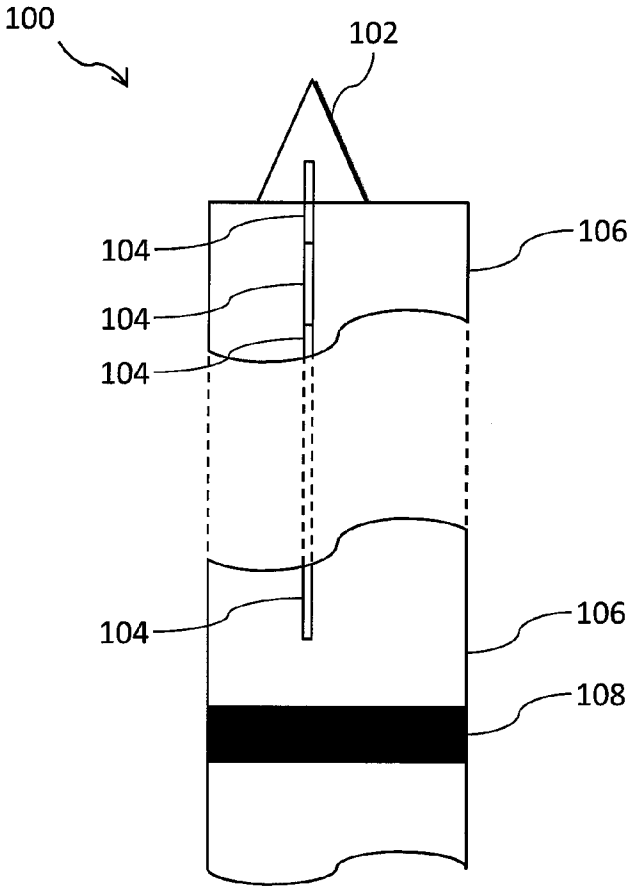
FIG. 1*a* shows a schematic diagram of a drilling rig system comprising a drilling rig and rock formations being drilled into.

FIG. 1*a* shows a schematic diagram of a drilling rig system 100 with which embodiments may be used. The embodiment below will be described generally in the context of a casing string being lowered by a drilling rig into an oil well bore. However it will be apparent that embodiments are not limited to such situations, and includes the situations in which any member, in particular, a tubular member, is moved (i.e. lowered or raised) within a well bore. Such situations would include, but are not limited to, the drilling of both production and injection wells for a oil or gas recovery system, as well as the drilling of well bores into aquifers and the like.

The system 100 comprises a drilling rig 102 which is configured to drill into the rock formations below it. A casing string, comprising a plurality of joints 104, is shown extending into the rock formations from the rig 102. The rock formations comprise a first layer 106, below which a hydrocarbon bearing reservoir 108 is located. It will be understood that this diagram is simplified, and that the rock formations may be significantly more complex than those shown; for example the upper layer of rock 106 may comprise multiple discrete layers having different compositions. Equally, the reservoir 108 may contain multiple hydrocarbon bearing layers sandwiched by non-hydrocarbon bearing rock layers. It will also be understood that embodiments are equally applicable for offshore rigs (although a sea water layer is not shown in the figure).

FIG. 1*b* shows a more detailed schematic diagram of the drilling rig 102 shown in FIG. 1*a*. As in FIG. 1*a*, the joints 104 of the casing string are shown extending downward from the rig into the rock formations below. The rig 102 comprises a derrick 110 which provides a frame to support the various members of the rig, and which extends upwards so that loads (in particular the casing string) may be suspended therefrom to be raised and lowered.

At the base of the derrick are slips 112, through which the casing string 104 passes. The slips 112 can be applied so as to grip the casing string 104 to prevent its movement and equally may be released to allow the raising or lowering of the casing string 104. It will be apparent that while the term slips is used herein, any device or means capable of selectively gripping and releasing the casing string may be used in its place.

Connected to the derrick 110 is a suspending system 114 from which a load (in this case the casing string) may be suspended to be raised and/or lowered. In this example the suspending system 114 comprises: an upper 'crown block' 116 which is attached to the derrick 110; a lower 'travelling block' 118 which is linked to the crown block 116 by several loops of a drilling cable 120; and a hook 122 which is attached to the travelling block 118. The drilling cable 120 extends from the crown block to a winch or 'draw-works' 124.

By reeling in and reeling out the drilling cable from the draw-works 124, the travelling block 118 and hook 122 may be lowered and raised, the multiple sheaves in the blocks providing a mechanical advantage. Loads, such as the casing string, can be suspended from the hook 122, such that they are raised and lowered.

The rig 102 is capable of measuring the 'hook load'; that is, the downward force or load on the hook 122 (or more generally on the suspending system 114). The hook load may be measured by a dedicated device, or may be measured by systems integrated into the suspending system 114 and/or draw-works 124. For example, the hook load may be measured by a strain gauge measuring the strain in the drilling cable 120; by a device measuring torque on the drum in the draw-works 124, or by a special linkage between the travelling block 118 and the hook 122. Many systems and methods for measuring the hook load are known in the art, and may be used in embodiments.

It will be understood that the suspending system 114 described above is purely exemplary, and that any mechanism capable of moving a member, in particular, a tubular member such as a casing string, within a well bore may be used. For example, the hook 122 may be replaced by a set of jaws arranged to grip the casing string, and the blocks 116 and 118 may be replaced by a hydraulic or pneumatic system. Some rigs are capable of exerting a downward force onto a tubular member, so as to force the tubular member into the well bore. In general, the rig may comprise a moveable unit (for example a hook) which is attached to the tubular member (for example, the casing string), and is used to move the tubular member within the well bore (either to raise or lower it).

The operation of the rig 102 described above when running (lowering) a casing string will now be described below with reference to FIGS. 2*a* to 2*d*. As briefly mentioned above, this process is performed over a number of cycles. Each of FIGS. 2*a* to 2*d* shows a simplified version of the rig 102 shown in FIG. 1*b* at different points in a cycle.

Figures 2A, 2B, 2C, 2D:
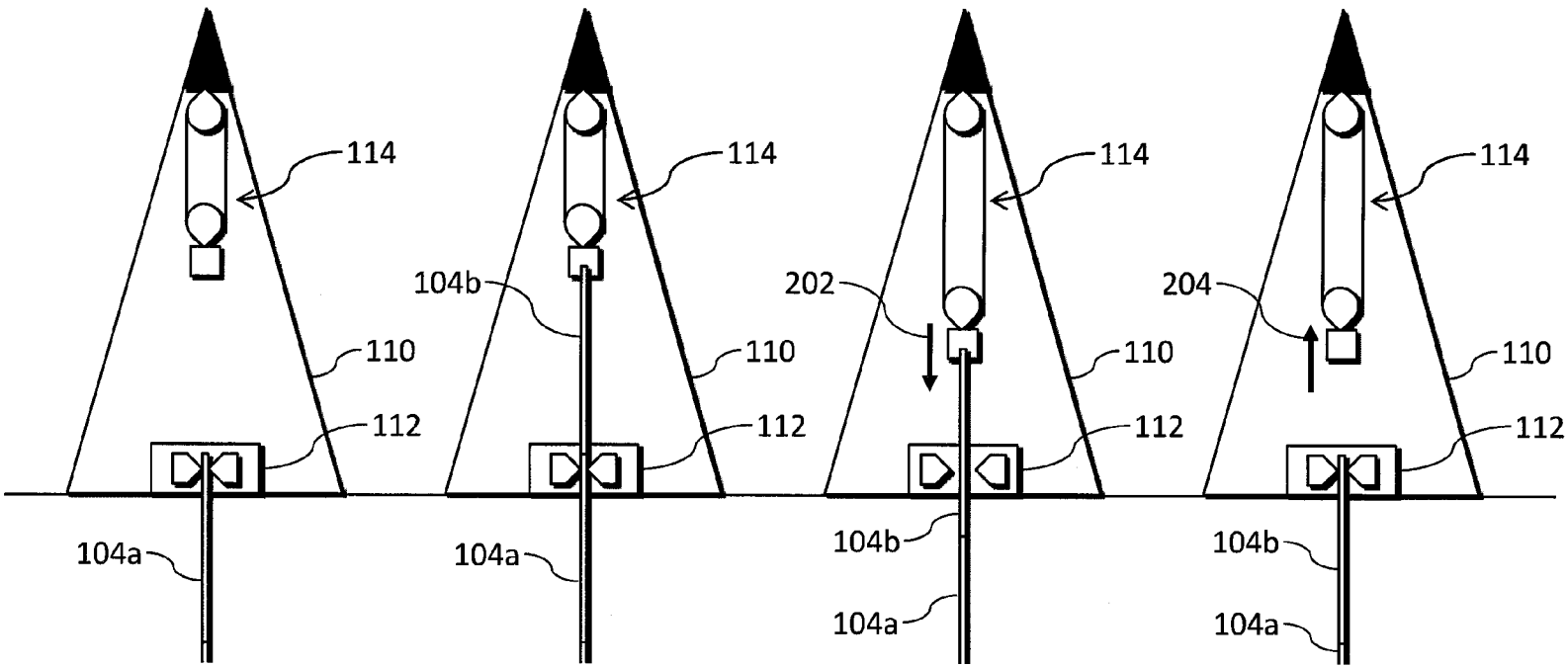
FIGS. 2*a* to 2*d* show schematic diagrams of the rig of FIG. 1*b* as it performs the steps in a lowering cycle.

The beginning of a cycle is shown in FIG. 2*a*: in this figure the uppermost joint 104*a* of the casing string is held in the slips 112 and the suspending system 114 is raised. As discussed above, "joint" is a well known term in the art and refers to a section of the casing string.

In the second step of the cycle, as shown in FIG. 2*b*, a new joint 104*b* is attached to the top of the casing string. Furthermore, the casing string as a whole, with the new additional joint 104*b*, is attached to the suspending system 114.

Having attached the new joint 104*b*, the slips are released so that the casing string is now suspended from the suspending system 114. The suspending system 114 then lowers the hook, and the attached casing string, into the well bore. This is shown in FIG. 2*c* by the arrow 202.

Finally, once the new joint 104*b* of the casing string has been lowered into the well bore, the slips 112 are applied so as to grip the joint 104*b*. Then as shown in FIG. 2*d*, the casing string/joint 104*b* is released from the suspending system 114, and the suspending system 114 is raised (as shown by arrow 204) so as to return to the position shown in FIG. 2*a*, ready for the next joint. The cycle then repeats for subsequent joints.

While the above has been described with reference to a single joint, some derricks are sufficiently tall to be able to accommodate multiple joints in each cycle. That is, the additional length of casing string which is attached per cycle comprises 2, 3 or even 4 joints (for example, of lengths 80, 120 and 160 feet respectively, corresponding to approximately 24, 36 and 48 m). It will be understood that such extended lengths may be used in embodiments.

During any given cycle, the hook load is measured by the rig, and the hook load output to a computer system. In view of this, embodiments provide systems, and methods and computer programs which may be used while moving a member, in particular, a tubular member such as a casing string within a wellbore to identify forces on the member. To do this, embodiments may include a computer system running friction measuring (FM) software components which enable the system to identify these forces and, if desired, predict a stuck pipe, or other undesired occurrence, as will be described in more detail below. In one particular embodiment, the system may identify friction between the member and the well bore, and based on this identification may forecast, for example, differential sticking. This is described with particular reference to FIGS. 4 to 7. In another embodiment, the system may identify viscous drag in the well bore, and use this to identify downhole pressure waves. This is described with particular reference to FIGS. 9 and 10.

The computer system may be located in a rig control centre (which may be part of the rig or located a substantial distance from the rig, including in a different country).

Alternatively, the computer system may be part of the control systems of the rig, and for example might be integrated with the systems controlling the draw-works 124. The FM software components may comprise one or more applications as are known in the art, and/or may comprise one or more add-on modules for existing software.

Figure 3:
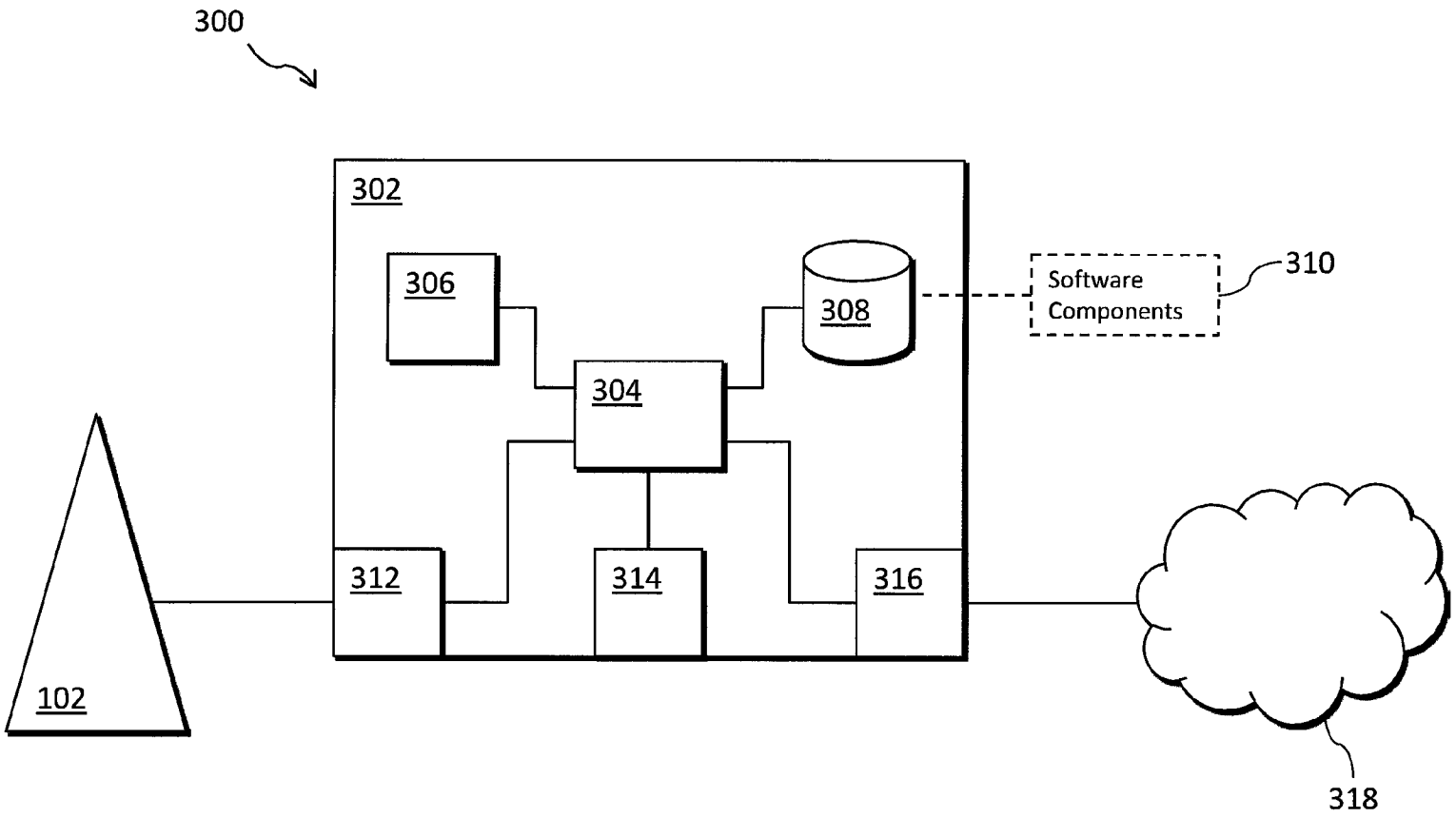
FIG. 3 shows a schematic diagram of a processing system in which embodiments may operate.

A schematic block diagram showing such a computer system will now be described with reference to FIG. 3. The computer system 300 comprises a processing unit 302 having a processor, or CPU, 304 which is connected to a volatile memory (i.e. RAM) 306 and a non-volatile memory (such as a hard drive) 308. The FM software components 310, carrying instructions for implementing embodiments, may be stored in the non-volatile memory 308. In addition, CPU 304 may be connected to one or more interfaces such as rig interface 312, user interface 314 and a network interface 316.

The rig interface 312 is connected to the rig 102 as described above, and is able to receive data indicative of the hook load as measured by the rig 102. The rig interface may also receive data indicative of, for example, the position of the suspending system 114 (i.e. the height of the hook), the operating mode (applied or released) of the slips 112, or any other operational data related to the rig 102 which may be required to implement embodiments.

The user interface 314 may provide inputs and outputs for the operator of the rig. The nature of these inputs and outputs, and their use to the rig operator will be apparent from the description below. The network interface 316 may be a wired or wireless interface and is connected to a network, represented by cloud 318. The computer system 300 may receive data or software components via the network 318, and may provide an output to other computer systems via the same.

In operation, and in accordance with standard procedures, the processor 304 retrieves and executes the FM software components 310 stored in the non-volatile memory 308. During the execution of the FM software components 310 (that is when the computer system is performing the actions described below) the processor may store data temporarily in the volatile memory 306. The processor 304 also receives data through rig interface 312 (and/or the user interface 314 or network interface 316 as required to implement embodiments).

As defined by instructions within the FM software components 310, the processor 304 processes the received data. Having processed the data, the processor 304 may provide an output via any of the interfaces 312, 314 and 316. Such processes will be readily apparent to the skilled person and will therefore not be described in detail.

Figure 4:
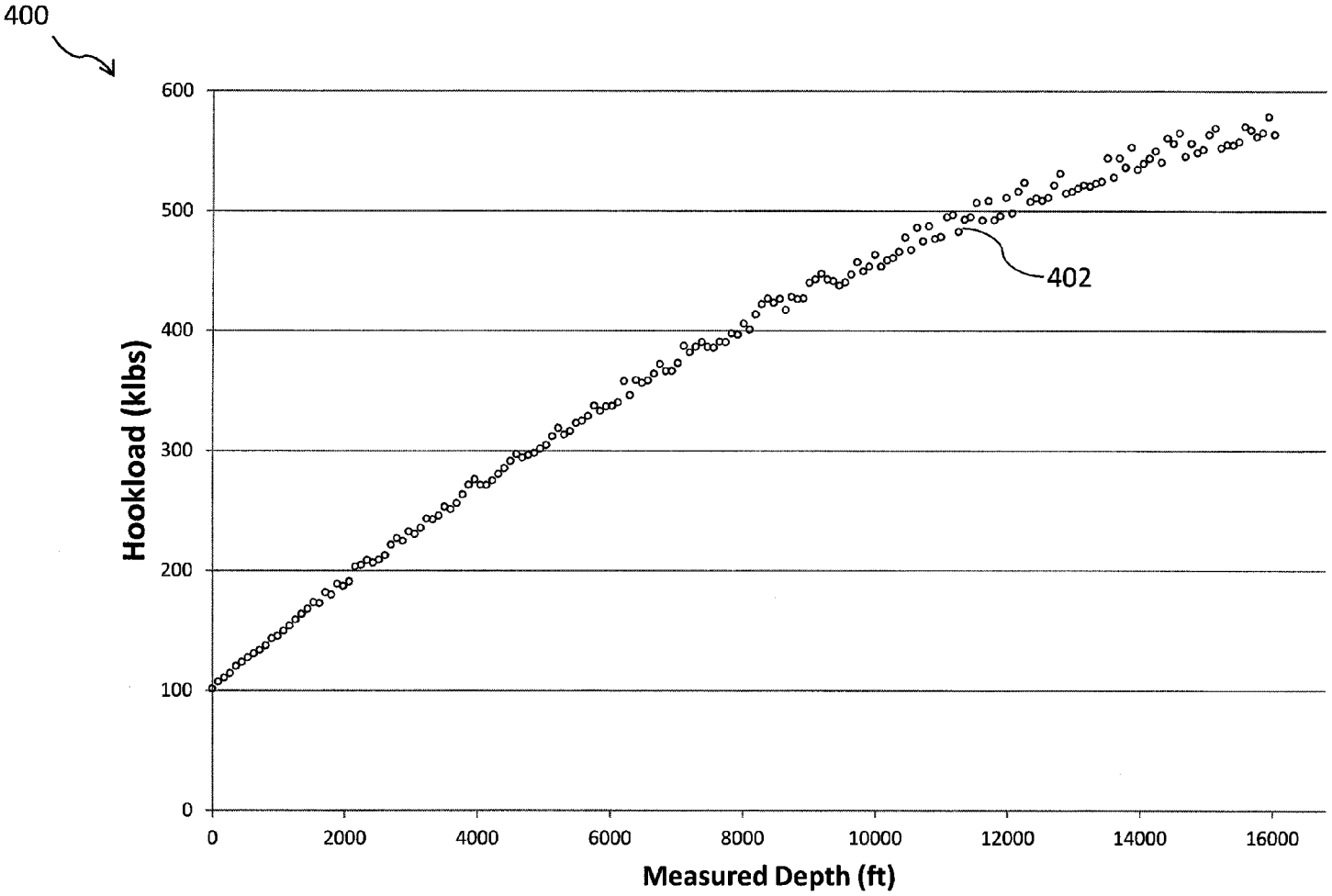
FIG. 4 shows a plot of hook load against the measured depth for a first example run.
Figure 6:
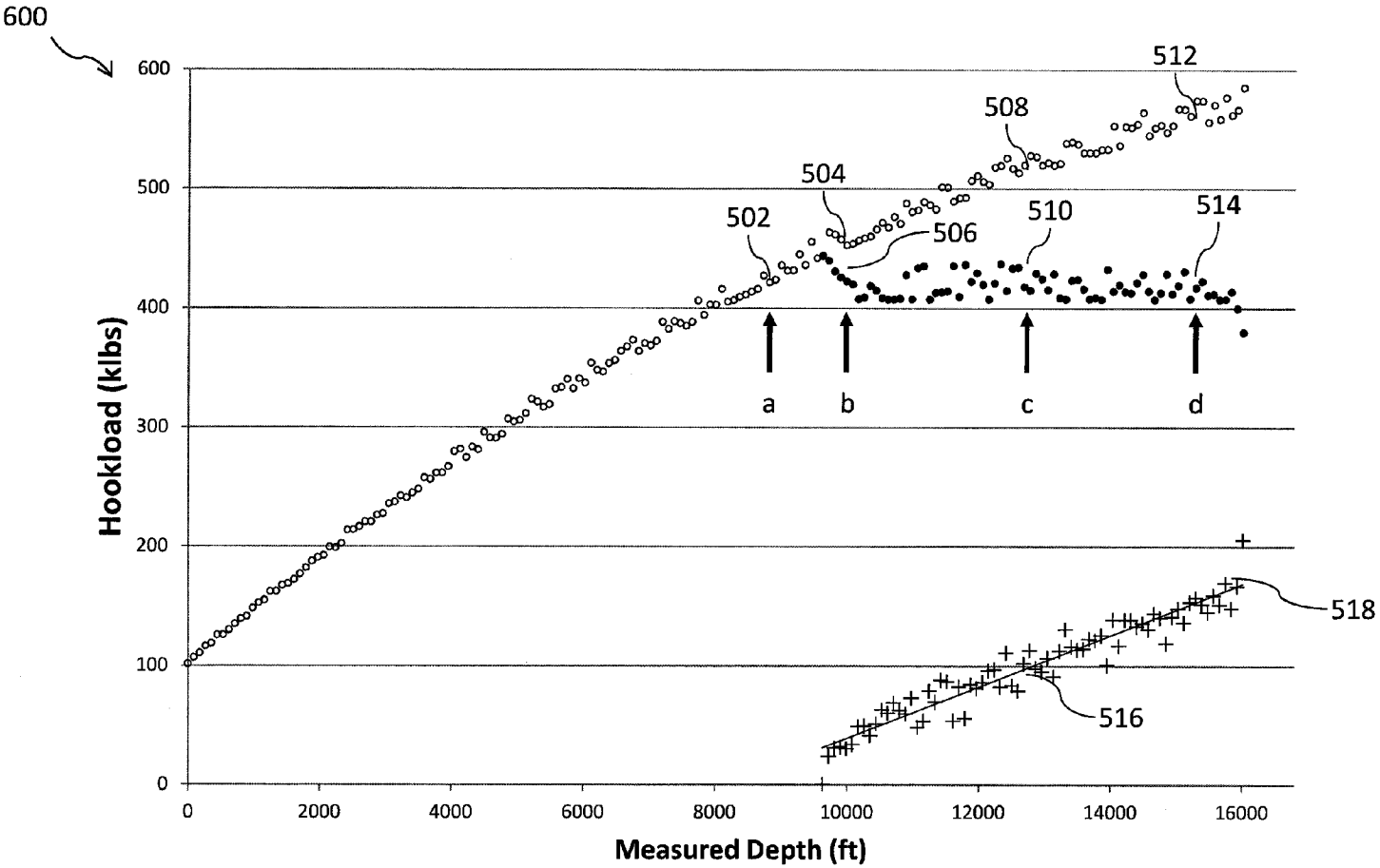
FIG. 6 shows a plot of hook load against the measured depth for a second example run.
Figure 7:
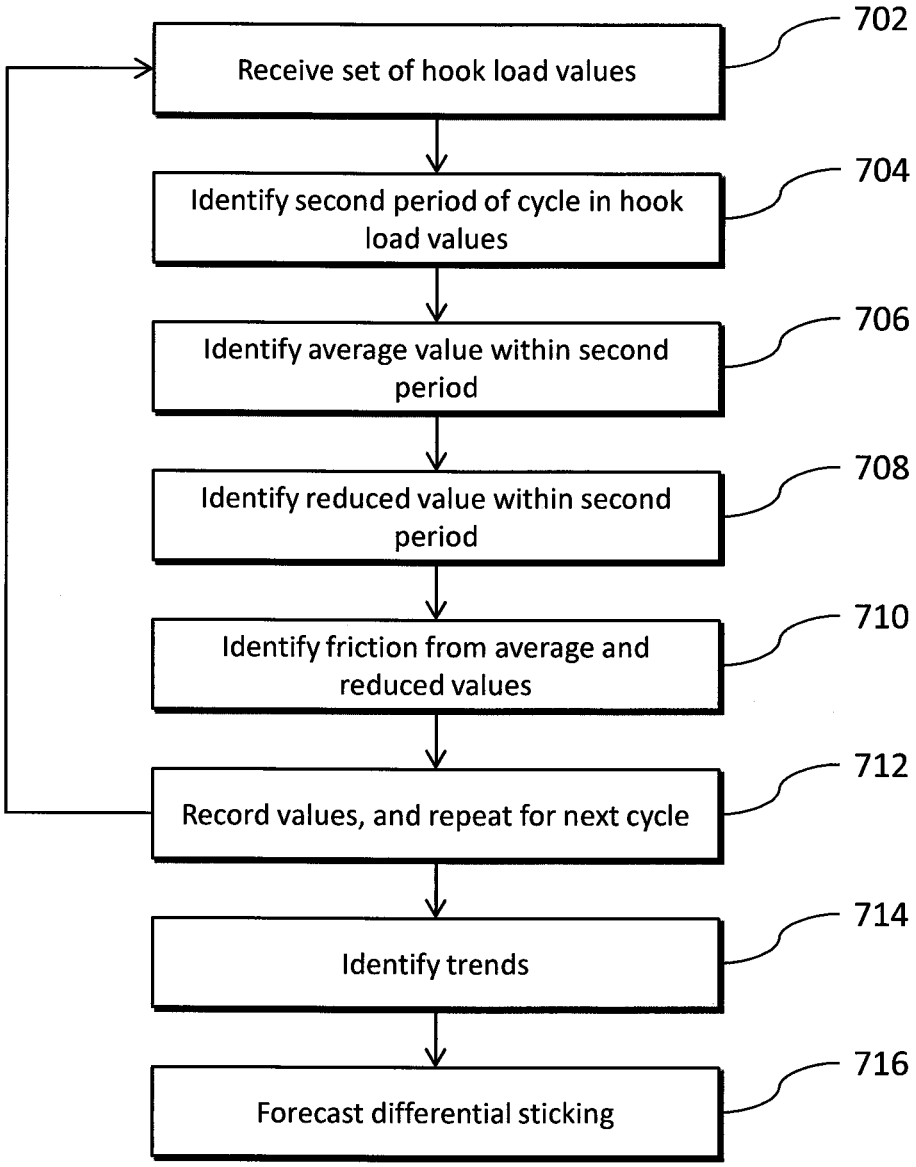
FIG. 7 shows a method for detecting friction according to an embodiment.

Embodiments are able to identify the forces on the member, in particular, a tubular member such as a casing string. These forces may be caused by friction between the member and the well bore, or alternatively by viscous drag on the member caused by displaced fluid. Further, embodiments are able to forecast or predict future sticking of the member from this identified friction. An exemplary configuration and output of computer system 300 will now be described with reference to FIGS. 4 to 7. FIGS. 4 to 6 show plots of measurements derived from hook load values received during cycles. FIG. 7 shows an exemplary method for identifying friction between a casing string and the well bore. The methods described below may all be implemented by the system 300 as embodiments. Also, as discussed above, the methods described below may also be implemented by the system 300 when moving other tubular members within a wellbore.

By way of background, a plot of hook load against the depth of the well bore (i.e. the length of the casing string) will be described with reference to FIG. 4. Each point 402 (white circles) in the plot represents a measurement of the steady state hook load during a given cycle. As mentioned above, the data represented in this plot is customarily recorded during the running into a wellbore of a casing string. It can be seen from the plot that the hook load increases as the depth increases (indicative of the increasing weight of the lengthening casing string); however the increase is not linear owing to the changes in dynamic friction causes by the lengthening of the casing string, as well as changes in viscous drag and buoyant forces acting on the casing string.

The data shown in FIG. 4 represents the previously known method for identifying the steady state hook load value. As mentioned above, these steady state values can be measured "by eye" by an operator as the casing string is lowered. In the plot shown in FIG. 4, differential sticking occurred after approximately 16,000 feet (4900 m); however, as can be seen, there is little in the data which would indicate that such differential sticking was about to happen. Consequently, it can be seen that while the steady state hook load might be recorded for the running of a casing string, the steady state hook load data cannot be used to identify static friction in the well bore.

As stated above, embodiments identify static friction in the well bore. To this end, the rig 102 and computer system 300 are arranged such that the rig 102 measures the hook load at a plurality of points during each lowering cycle and transmits data containing a plurality of load values thereby measured to the computer system 300. This data is received by the computer system 300 and is analysed, in accordance with the programming instructions encoded within the FM software components, so as to identify static friction and to predict differential sticking. A method which may be performed by the computer system 300 to do this is described with reference to FIG. 6 below. However, to put this method into context, FIGS. 5 and 6, showing plots of hook load data, will first be described. The hook load data shown in FIGS. 5 and 6 may be analysed by the computer system 300, however it will be understood that the computer system does not have to generate such plots in order to carry out methods according to embodiments, such as that described in relation to FIG. 6.

FIGS. 5*a* to 5*d* show four plots of the hook load during a single cycle. These plots are pictorial representations of the hook load values which are received and analysed by the computer system 300 in embodiments. As can be seen from the detail in the plots, the hook load has been sampled at multiple points during the respective cycle. In the plots shown, the sampling frequency was once every 5 seconds, to give approximately 40 hook load values for a given cycle. However, as discussed below, the person skilled in the art will understand that higher or lower sampling frequencies may be used.

Figure 5A:
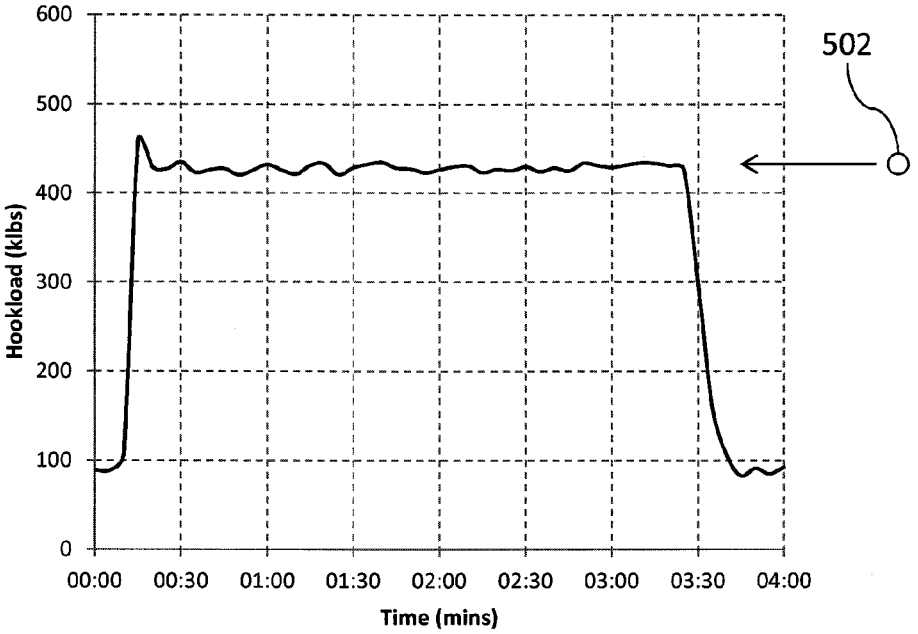
FIGS. 5 to 5*d* show plots of hook load against time during a cycle.

FIG. 5*a* shows a plot for a first cycle. At the beginning of the cycle (at time 00:00 minutes) the hook load is approximately 100 klbs (440 kN). This value represents the weight of those components (such as the hook 122) which are suspended in from the hook load measuring device, and therefore are included in the measurements.

At approximately 00:10 minutes the cycle starts with a relatively sharp increase in the hook load from approximately 100 to 450 klbs (440 kN to 2000 kN). This is caused by the slips 112 being released, and the weight of the casing string being transferred from the slips 112 to the suspending system 114 (corresponding to the transition from FIG. 2*b* to FIG. 2*c*). In the plot, the hook load reaches a maximum before dropping slightly down to a value of approximately 425 klbs (1900 kN) at a time of 00:20 minutes. Such minor oscillations in the hook load may occur (and are typically caused by the elasticity in the system). The sharp increase, and any subsequent oscillations, may be considered to define a first period in which the load (or weight) of the casing string is transferred from the slips 112 to the suspending system 114.

After this first period, the weight of the casing string is fully suspended from the suspending system 114 and can therefore be lowered into the well bore. This corresponds to the situation shown in FIG. 2*c*. As the casing string is lowered, the hook load oscillates, by approximately ±10 klbs (±44 kN) above and below an average value of approximately 425 klbs (1890 kN). This average value is marked by a white circle 502, whose level at approximately 425 klbs (1890 kN) is indicated by an arrow. The period during which the casing string is suspended from the suspending system 114, and is being lowered into the well bore may be considered a second period (which terminates at the beginning of the third period defined below). The arithmetic mean of the hook load may be calculated from samples taken during this period whereby to define the average hook load value; however other average values, such as modal class or median value may be used.

At the end of the cycle is a third period, in which the slips are applied and the weight of the casing string is transferred from the suspending system 114 to the slips 112. This third period is defined by a relatively sharp decrease in the hook load to a level similar to that at the beginning of the cycle. The decrease in hook load marks the start of the third period and consequently the end of the second period.

Figure 5B:
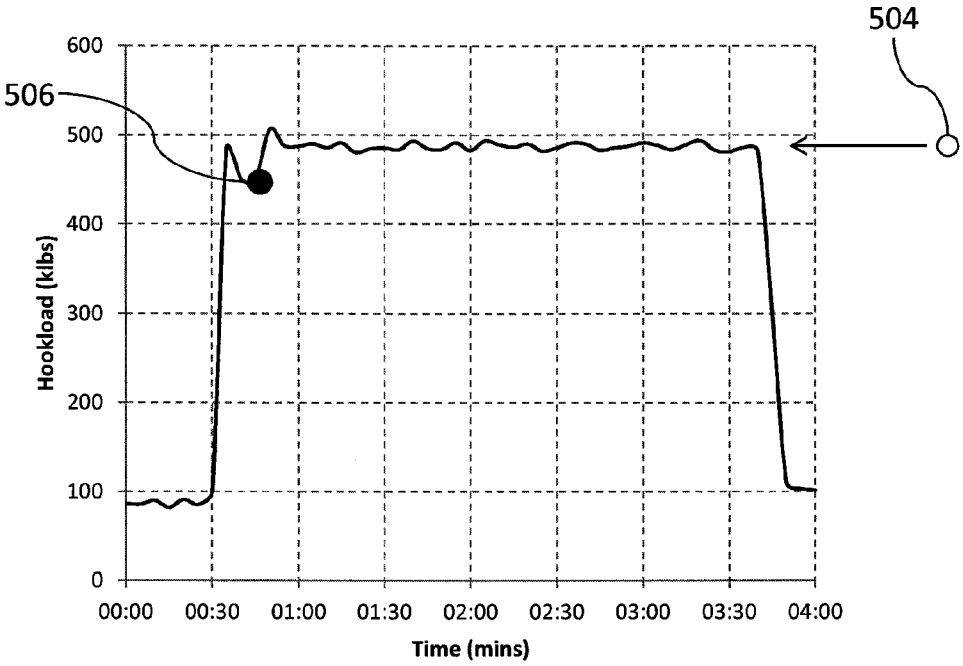

FIG. 5*b* is similar to FIG. 5*a*, in that the hook load starts at a low value of approximately 100 klbs (440 kN), before sharply increasing during a first period. During the subsequent second period the hook load remains approximately constant at a value of approximately 480 klbs (2140 kN), indicated by white circle 504, and then drops in a third period.

However, as can be seen, at the start of the second period, there is a drop in the hook load to a level of approximately 440 klbs (1960 kN), before the hook load increases to the average value of approximately 480 klbs (2140 kN). This reduction in hook load is generally caused by static friction in the well bore (which supports some of the weight of the casing string). As the time progresses, the downward force on the area of static friction increases until the static friction is overcome. With the reduction in friction associated with the overcoming of the static friction and thus the transition to dynamic friction, the force on the hook increases, and consequently the hook load value increases to its average value 504. The hook load will generally reach a minimum just before the static friction is overcome. This minimum value is marked by the black circle 506 and will henceforth be referred to as the reduced hook load value.

Figure 5C:
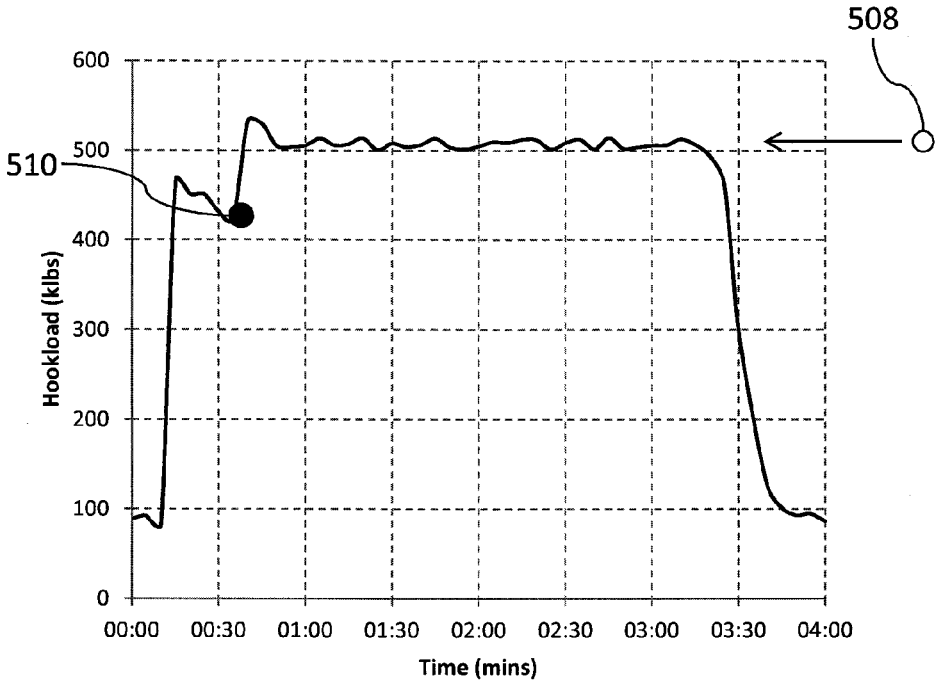
Figure 5D:
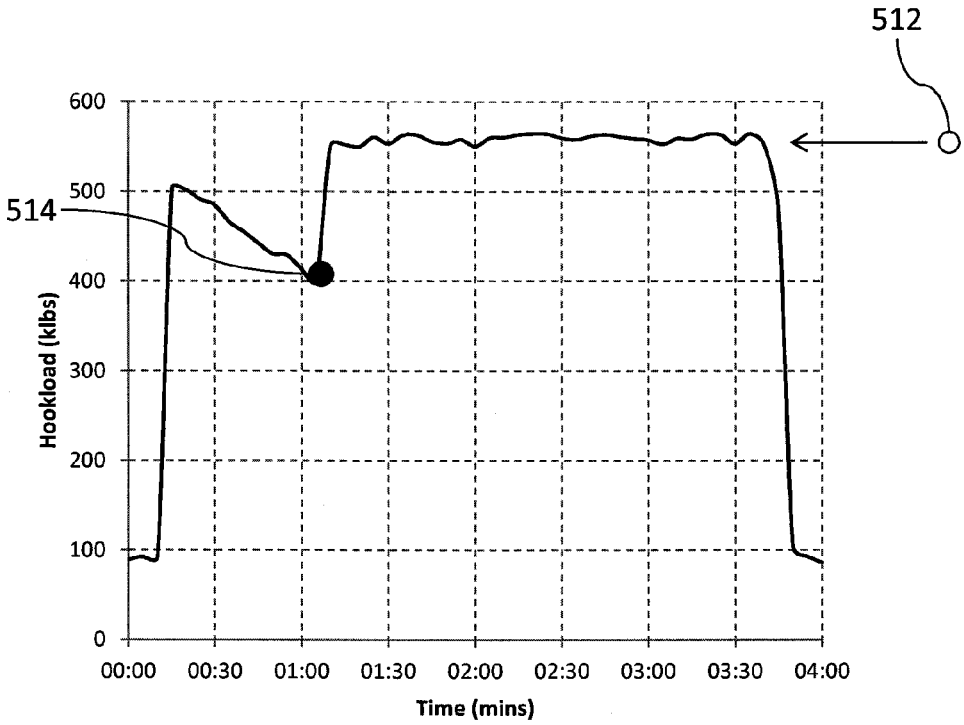

FIGS. 5*c* and 5*d* show the same effect as FIG. 5*b*, namely that of a drop in hook load at the beginning of the second period of the cycle; however in each case the difference between the average value and the reduced value is more pronounced.

In FIG. 5*c*, the hook load initially increases to a value of approximately 470 klbs (2090 kN), before dropping to a value of approximately 420 klbs (1870 kN). After this point (as the static friction is overcome) the hook load value increased to the average value of approximately 500 klbs (2220 kN). The average value is marked by white circle 508 and the reduced value by black circle 510.

In FIG. 5*d*, the hook load initially increases to a value of approximately 510 klbs (2270 kN), before decreasing to a value of approximately 400 klbs (1780 kN). The hook load value subsequently increases to the average value of approximately 560 klbs (2490 kN). The average value is marked by white circle 512 and the reduced value by black circle 514.

FIG. 6 shows a plot, similar to that shown in FIG. 4, but with both the white and black circles plotted. Each of the plots shown in FIGS. 5*a* to 5*d* contribute a white data point to the plot, and, if applicable, a black data point. The depths corresponding to each plot are marked by arrows a to d, each corresponding to FIGS. 5*a* to 5*d* respectively. In addition, a set of points showing the difference between the average values (white dots) and the reduced values (black dots) are shown as crosses 516. This calculated difference may be considered an indication of the friction in the well bore. A trend line 518, calculated using regression analysis, is shown, representing the trend of the points.

As was apparent from FIG. 5*a*, there was no clearly defined decrease in hook load (i.e. no clearly defined reduced hookload value/black circle). This is applicable for all measurements taken before about 9500 feet (2900 m). Therefore, for clarity the corresponding black circles are not plotted on FIG. 6 for measured depths of 9500 feet (2900 m) or less (and may be assumed to take approximately the same value as the average hookload values/white circles). However, after 9500 feet (2900 m) of depth, the decrease in the load values becomes more clearly defined, and therefore the corresponding black circles are plotted on FIG. 6. As can be seen, the data points represented by the black circles detach from the data points represented by the white circles.

In the plot shown in FIG. 6, differential sticking occurred at approximately 16,000 feet (4900 m); however it can be seen that the parting of the white and black data points forecast this differential sticking from approximately 9500 feet (2900 m) in depth. This parting may be seen from the increase in the friction values, represented by the crosses). Therefore, in embodiments, the point at which the white and black data points diverge may be used to identify the friction in the well bore and consequently to forecast differential sticking.

A method by which the computer system 300 derives a measure of the static friction and therefore is able to predict differential sticking will now be described with reference to FIG. 7.

In step 702 a cycle as described above with reference to FIG. 2 begins. During the cycle the rig 102 transmits rig data to the computer system 300. The data is received through rig interface 312, and may be passed to the processor 304 for immediate analysis, or may be stored in either of memories 306 or 308 for later analysis. This data contains a plurality of hook load values received at a plurality of points during the cycle. The hook load values are indexed (such as by a timestamp, or a simple incrementing number), such that they may be identified in the order which they were measured. The received data may, in addition, contain data on the operational state of the slips, and/or the position of the hook/suspension system, this data may also be indexed.

In step 704 the processor 304 analyses the data so as to identify the second period as described above with reference to FIG. 5, the second period being the period in which the casing string is suspended from the suspending system 114 and is lowered into the well bore. There are a number of methods by which the processor 304 may identify the second period within the received data: one example is to identify sharp increases and decreases in the load values associated with transfer of the weight of the casing string between the slips 112 and the suspending system 114. Alternative methods will be discussed below. In identifying the second period, the processor 304 identifies the index of the start and end points of the second period.

In step 706, having identified the second period, the processor 304 identifies those hook load values corresponding to points in time within the second period. In other words, the processor identifies those hook load values which have an index value between the start and end points identified in step 704. The processor 304 then calculates an average value for the identified hook load. The average value may be calculated as the mean, median or mode of the hook load data values.

In step 708, the processor 304 additionally analyses the hook load values corresponding to the second period to identify a reduced value. In this example, this reduced value is calculated by the processor to be the minimum of the hook load values corresponding to the second period.

In step 710, the processor 304 calculates a friction value indicative of the friction in the well bore. In this example, this friction value is the difference between the average and reduced values; however other methods may be used, such as those that involve calculating a value indicative of friction per unit length (the difference between the average and reduced values, divided by the total length of the casing string). Alternatively, the reduced value may be directly taken as the friction value.

In step 712, one or more of the average value, reduced value or friction value are stored in one or both of the memories 306 and 308. Alternatively or additionally, the values may be transmitted to a remote station using the network interface 316, or provided to an operator using user interface 314. The values may be stored with an identifying index, such as the total depth of the well bore or length of the casing string so that trends between multiple lowering cycles may be determined. The steps 702 to 712 are then repeated for the subsequent lowering cycles.

After a number of cycles have been analyzed as described in steps 702 to 712 the processor 304 may analyse the recorded data as described below in steps 714 and 716.

One method by which the processor 304 analyses the data is to identify trends in the average value, reduced value and/or friction value, as shown by step 714. There are many methods by which this may be done; however, in general, the processor looks for a series of consecutive lowering cycles for which the values are indicative of a consistently high or increasing level of static friction. For example, the processor 304 may calculate a rolling average of the friction values for a given number of lowering cycles (such as 20, but any appropriate number may be used). In this way, the processor 304 is able to filter out minor variations, errors, and single anomalous lowering cycles which produce a high friction value.

As an alternative, regression analysis or similar techniques may be used to derive a trend for a series of data values. This analysis may similarly be performed on a rolling basis, using a set of data points. Such a trend is shown in FIG. 6, and was calculated for the friction values from a depth of 10,000 ft to 16,000 ft (approximately 3000 m to 4900 m).

Having determined any trends in the data (in step 714) the processor 304, in subsequent step 716, may then use the calculated trends to forecast a stuck pipe condition. For example, the processor 304 may compare the rolling average of the friction values against a threshold, and if the processor 304 determines that the rolling average is above the threshold, the processor determines that a stuck pipe is likely to occur. Alternative methods may be used, such as extrapolating the trend line calculated in step 714 to the target depth of the well bore, and comparing the extrapolated friction value at the target depth to a threshold value. Should the value be above the threshold, this may be taken to be an indication that a stuck pipe condition (caused by high static friction) will occur before the target depth is reached. In some embodiments the processor may calculate a probability of a stuck pipe condition occurring. For example, the processor 304 may divide the current or forecast friction value by a predetermined number to derive a percentage probability of a stuck pipe condition occurring.

Having identified a forecast of the probability of a stuck pipe condition, the processor may output data through one or more of the interfaces 312, 314 and 316, to, for example, alert the operator of the rig that differential sticking is occurring and is likely to result in a stuck pipe.

Therefore, in embodiments, the multiple samples of hook load over time (during a cycle) are analyzed to identify not only the average (or steady state) hook load value, but to detect static friction from changes, during a cycle, in the hook load values. These changes may not only be used to identify static friction, but to predict the occurrence of a stuck pipe condition.

Additional Details and Modifications

The method described above, in particular that with reference to the trend 516 in FIG. 6, indicates that a large number of cycles will show a difference between the minimum and average hook load values prior to a stuck pipe condition occurring. However this may not be the case, and less than five, in particular only two or three cycles may show this difference before a stuck pipe condition occurs. As such, in some embodiments, two, three or four adjacent cycles, in which there is a significant difference between average and minimum hook load values, may be taken as an indication that differential sticking is occurring. At which point the casing may be partially withdrawn and re-lowered to alleviate the problem.

The above embodiments have been described in the specific context of lowering a casing string into a well bore; however other uses are envisaged. For instance, embodiments are applicable to any situation where a tubular member is moved within a well bore (either being raised or lowered). Moreover, the tubular member may be embodied by an alternative element to a casing string, such as a liner string, production tubing string, injection tubing string or a drill string.

Moreover, while the casing string has been described as being suspended from the suspension system 114, the rig 102 may alternatively be arranged to force the tubular member into the well bore. In such cases the load values may represent the force required to force the tubular member into the well bore. Consequently, any system which provides a moveable unit to which the tubular member is attached (to be raised, lowered, or forced down) may be utilised in conjunction with embodiments.

In the above embodiments, the index for identifying points during individual lowering cycles was time, and the index for identifying different lowering cycles was measured depth (i.e. the length of the tubular member in the well bore). However it will be understood that any appropriate index may be used.

The detection of the second period may be done in a number of ways, for example, the processor 304 may look for the rapid changes in hook load to define the boundaries of the periods. The system may include a guard interval to this period to ensure that any oscillations in the hook load associated with the transfer of weight do not produce errors in the results. The guard interval may be a predetermined period of time (i.e. a period of a given number of seconds), or may be determined from analysis of a given number of data samples, for example, by looking for oscillations in the data samples.

Alternatively, the processor 304 may be able to receive data on the operational state of the slips 112 or of the suspending system 114 through the rig interface 312. The processor 304 may use this data to define the second period, for example by looking for the slips opening and closing, or looking at the position or movement of the suspending system 114. For instance, the processor 304 may look for the conditions in which the hook 122 of the suspending system 114 is moving, or in which the hook 122 is between a given set of positions. Other methods of identifying the second period will be apparent to the skilled person.

When detecting the reduced value, the processing system 300 may use a specified minimum value. However, alternatively the processing system 300 may remove errors by, for example, averaging a number of the lowest values, or defining the friction value as being at a given percentile of all the values (thereby excluding some of the very lowest values).

While the friction value described above was calculated as the difference between the average value and the minimum value in any given second period, the processor may alternatively identify other data to calculate this value. For example, the friction value may be calculated from the variance (or deviation) in the hook load values during a cycle. That is, the processor 304 may not only look for a decrease in the hook load values during a cycle, but for rapid changes (i.e. increases or decreases) and oscillations.

Alternatively, the processor 304 may look for relatively sudden changes in the load values which are indicative of static friction being overcome. In such embodiments the friction value may be calculated as the magnitude of any sudden increase in the hook load values. Some alternative situations will be described with reference to FIGS. 8*a* to 8*c*.

Figure 8A:
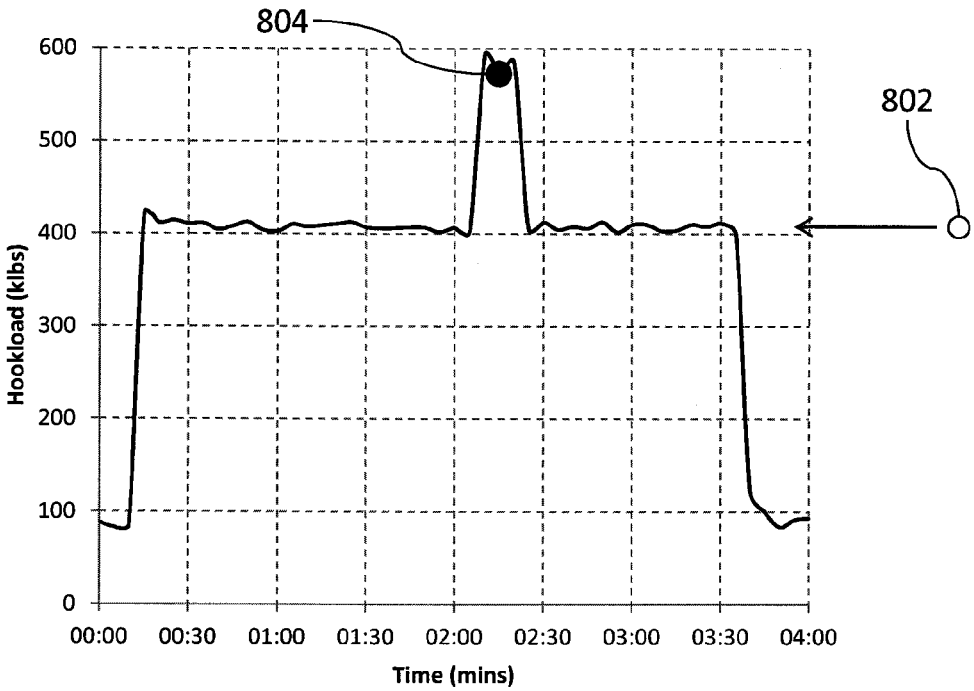
FIG. 8 shows further plots of hook load against time during a cycle.

The plot shown in FIG. 8*a* is indicative of a case in which the direction of movement of the hook has been reversed. In other words, the hook (and casing string) is first lowered (as with the embodiment described above), but between a time of 2:00 and 2:30 minutes the hook is raised, before being lowered again (after 2:30 minutes). In this case, an average hookload value 802 and a maximum hookload value 804 may be identified from the load values. The difference between these load values may be used to identify friction in the well bore, in particular it may be used to differentiate between upward buoyant forces and friction.

Figure 8B:
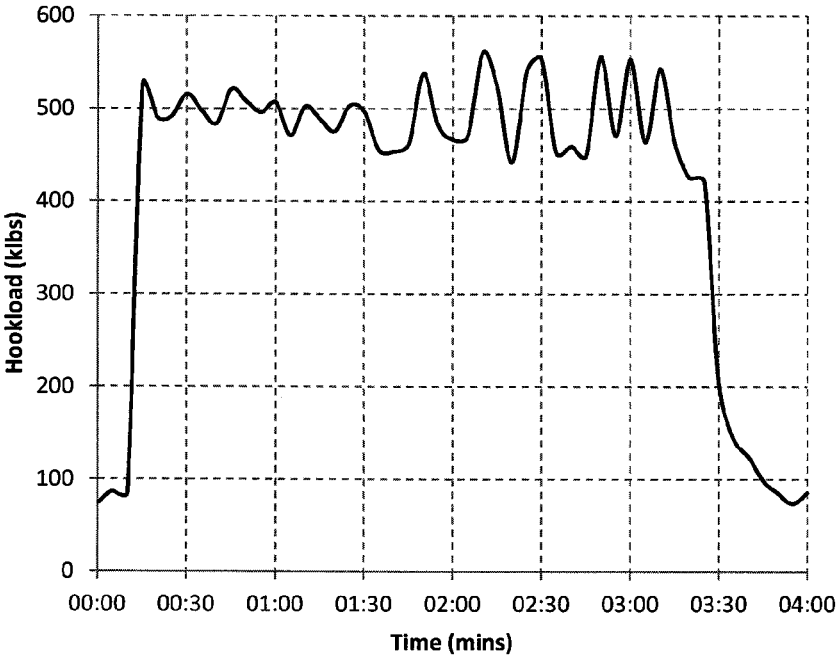

The plot shown in FIG. 8*b* is indicative of the case where there is a large degree of variation in the load values arising from friction between the wellbore and the casing string. In such cases, the degree of variation in the load values may be used as a measure of the degree of friction.

In this additional embodiment, the difference between the average and maximum hookload values in FIG. 8*a*, and the variation in load values in FIG. 8*b* may be recorded for a plurality of cycles, and consequently used to determine trends and the like (as described above with reference to FIG. 6).

Figure 8C:
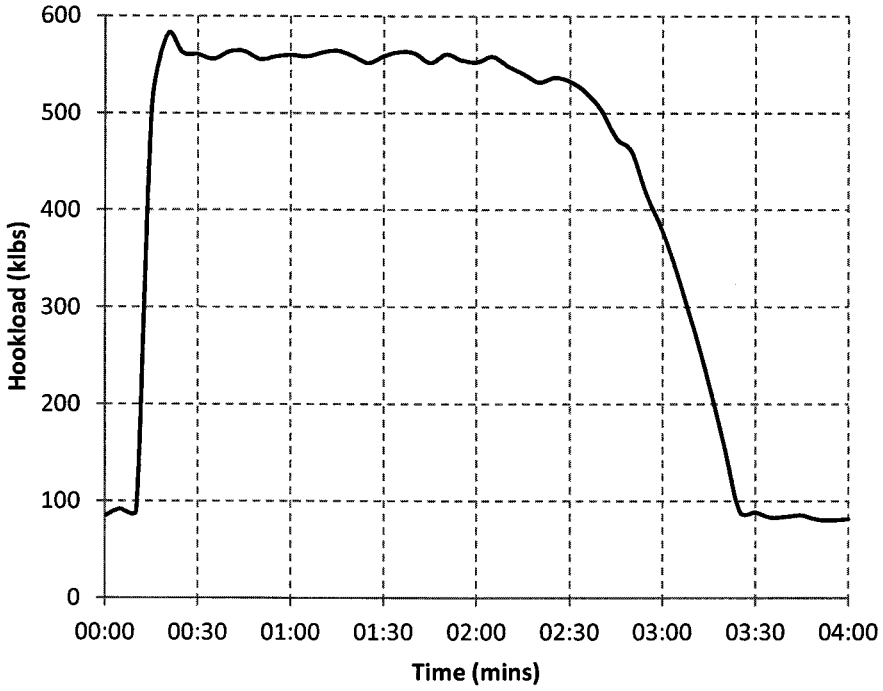

FIG. 8*c* shows a plot in the case that the casing string has become stuck. This is represented by the tapered reduction in the hookload values (to be contrasted with the more abrupt reduction associated with the slips being applied). In this case, an analysis of the hookload values during this cycle, and additionally a comparison between the hookload values of this cycle with previous cycles may enable the cause of the stuck pipe condition to be diagnosed. For instance, if the previous cycles did not show the indication of increased static friction (as shown in FIGS. 5*a* to 5*d*) then the cause of this stuck pipe condition may be diagnosed to be caused by, for example, a well bore collapse. This may facilitate in curing the stuck pipe condition, or in providing the rig operators with information on the well bore environment (to facilitate in future running in of a casing string or future drilling operations (i.e. extending the wellbore).

The frequency at which the hook load is sampled may be changed to give the best use of data. In the examples above, a sampling frequency of once every 5 seconds, giving approximately 40 data samples per cycle was used; however a much higher (i.e. from once every 0.1 seconds to 2 seconds, 10 Hz to 0.5 Hz) sampling frequency may be used.

The processor 304 may identify a steady state so as to identify the average value. The steady state may be defined as a period in which the hook load values are all within a predefined range of each other (or have a variation below a predetermined value) over a predefined period of time, such as from 15 seconds to 2.5 minutes, for example, 30 seconds or 1 or 2 minutes.

The above description has been focused in determining friction between the wellbore and the casing string, however this is not the only metric which can be determined based on a plurality of hook load values taken during a cycle. FIGS. 9 and 10 will be used to describe a method of determining a different force on a member being moved within a well bore, in this case viscous drag caused by the movement of the member.

Figure 9A:
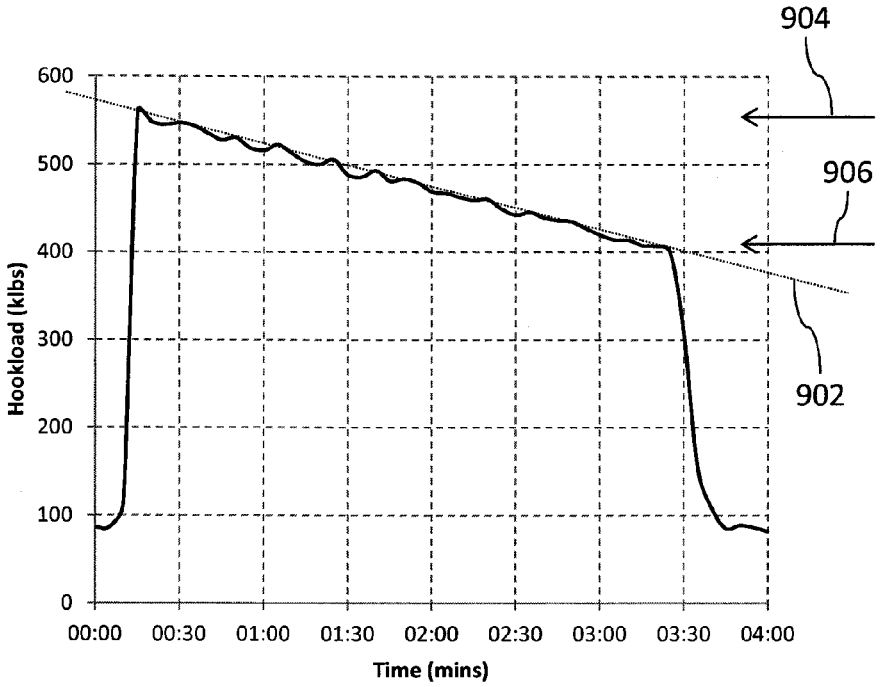
FIG. 9 shows plots of hook load against time during a cycle where viscous drag is a factor.
Figure 10:
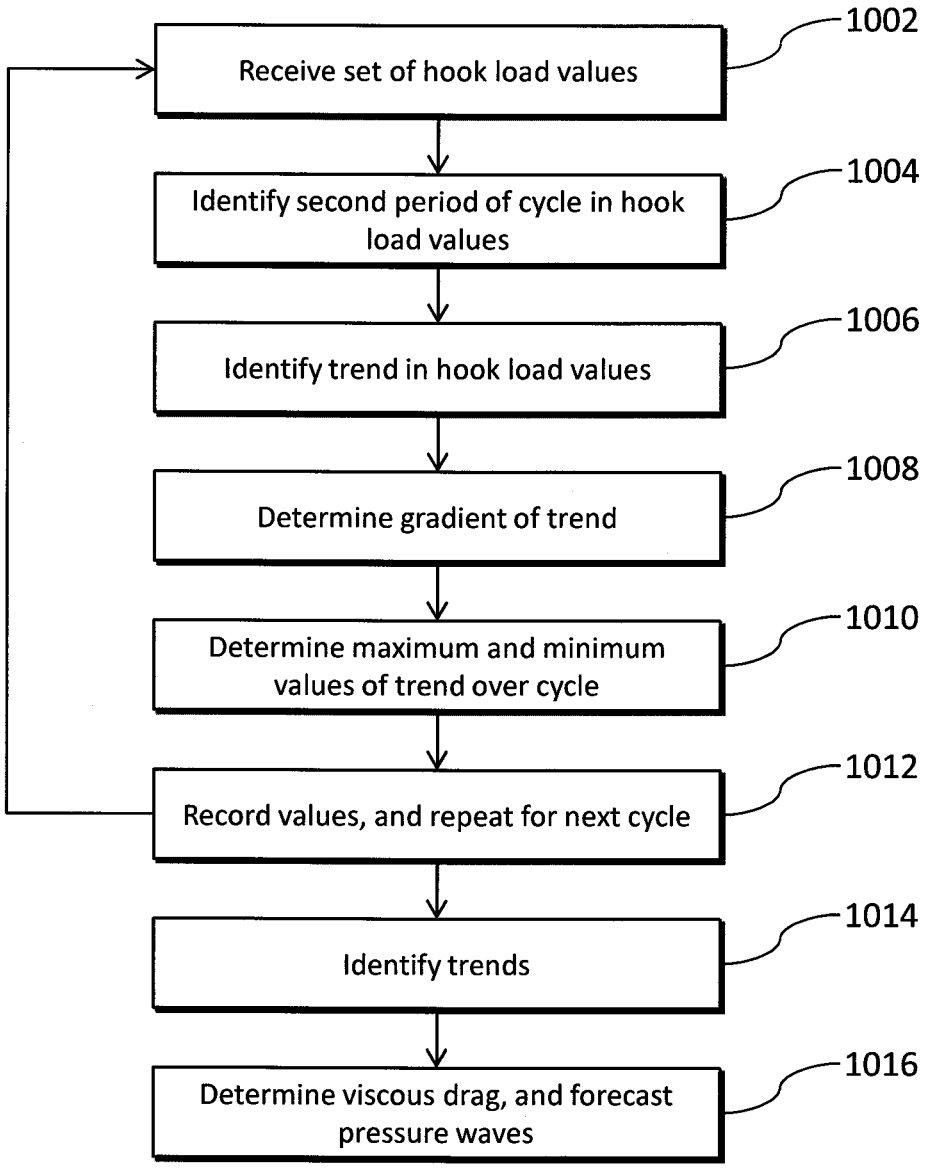
FIG. 10 shows a method for detecting viscous drag according to an embodiment.

FIG. 9A shows a plot of hookload against time as a casing is run-in-hole, i.e. lowered into a wellbore. As the casing is run-in-hole, fluid is displaced through the annulus, up the well bore towards the surface. The movement of fluid through the annulus towards the surface causes a viscous drag force opposing the movement of the casing (which is away from the surface). This viscous drag force can be observed as a reduction in the hookload as shown in FIG. 9A. As illustrated, as the casing is lowered, an increased amount of fluid is displaced, and therefore the drag increases. This is shown by the progressive reduction in the hook load throughout the cycle. Excluding the minor, short term variations, the progressive reduction is monotonic, and may be modeled as being approximately linear. As such a linear trend can be determined for this change in the hook load values. This trend is shown by line 902. The trend proceeds from a maximum value at the beginning of the cycle, indicated by arrow 904, to a minimum value at the end of the cycle, shown by arrow 906.

Figure 9B:
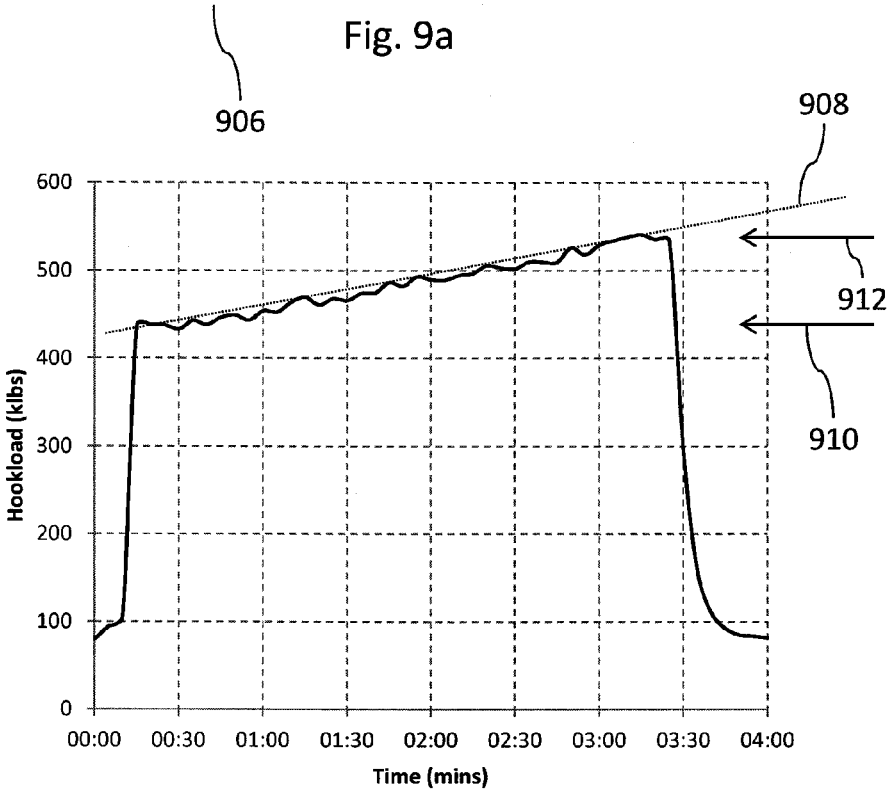

FIG. 9B shows a similar case where the casing is picked-up, that is lifted out of the wellbore. As the casing is raised, fluid is drawn along the annulus from surface. The viscous drag force again opposes the movement of the casing string, and is therefore observed as an increase in surface hookload as shown in FIG. 9B. In a similar manner to FIG. 9A, FIG. 9B shows how the hookload progressively increases, indicated by trend line 908. The trend proceeds from an initial minimum value at the beginning of the cycle, as shown by arrow 906, to a maximum value at the end of the cycle as shown by arrow 908.

The fluid flow caused by the movement of the casing string in the well bore may generate significant downhole pressure waves. In the case of the string being lowered, a downhole surge pressure wave may be created. The pressure of this wave should not exceed the open hole formation fracture pressure, otherwise fluid losses may occur, and fractures may form in the formation. Equally, when the casing string is being raised, a downhole swab pressure wave may be generated. The pressure caused by this wave should not fall below the open hole formation pore pressure, otherwise an influx of fluid into the well bore may occur, potentially leading to a well control incident.

The magnitude and rate of change of the viscous drag force may depend upon a number of design factors. These include the tubular size, annular clearance, the rate of decent or ascent of the casing, the length of casing moved and fluid properties.

Nevertheless, measures of the viscous drag force may be used to provide a method for determining the severity of swab and surge pressures, which cannot currently be measured downhole during casing, liner and completion running operations.

To measure the viscous drag forces, the magnitude of the force may be determined from the magnitude of the monotonic change in the values. This may be done by comparing the maximum and minimum values, as illustrated on FIGS. 9A and 9B. In some embodiments, these maximum and minimum values may be determined by, for example, taking an average of a predetermined number of values at the beginning and the end of the cycle, and differencing the two averages. Alternatively, a linear trend may be determined for the monotonic change, and the value of the trend at the beginning and end of the cycle may be used for the maximum and minimum values. It will be appreciated that any outliers, for example sudden peaks caused by differential sticking as described above, should be excluded in determining these maximum and minimum values. Alternatively, the gradient of the trend, i.e. rate of change in the hook load may be used as a measure of the viscous drag. Measures of viscous drag for a plurality of cycles, like the method above, may be used to predict downhole events.

A method by which the computer system 300 derives a measure of the viscous drag and therefore is able to predict downhole pressure waves will now be described with reference to FIG. 10.

Steps 1002 and 1004 are analogous to steps 702 and 704 above, and will therefore not be described in detail. In these steps the processor 304 receives hook load values and identifies the second period within these hook load values.

The processor then identifies a magnitude of the monotonic change in the hook load values. One method by which this may be done is illustrated in steps 1006 and 1008.

In step 1006, having identified the second period, the processor 304 trend in the hook load values during the second period. In other words, the processor identifies those hook load values which have an index value between the start and end points identified in step 704. The processor 304 then calculates a trend of the values. The trend may, for example, be calculated using, for example linear regression or other techniques. In calculating the trend, processor 304 may exclude any outliers. For example if a small amount of differential sticking is occurring, there may be a low value at the beginning of the cycle, as shown in FIG. 5*b*, which may be excluded so as to not skew the results.

In step 1008, the processor 304 additionally may determine the gradient of the trend as a measure of the viscous drag. Alternatively, or additionally, in step 1010 the processor may determine a maximum and a minimum value for the trend over the cycle. These values may correspond to the maximum and minimum values of the hookload over the cycle, however to exclude any outliers (caused by e.g. differential sticking), the trend may be used to determine the maximum and minimum. As such, the value of the trend line at the beginning and end of the cycle may be used to determine the maximum and minimum values as required. The difference between the maximum and minimum values may be used as a measure of viscous drag.

In step 1012, one or more values calculated above as a measure of the viscous drag (collectively viscous drag values) are stored in one or both of the memories 306 and 308. Alternatively or additionally, the values may be transmitted to a remote station using the network interface 316, or provided to an operator using user interface 314. The values may be stored with an identifying index, such as the total depth of the well bore or length of the casing string so that trends between multiple lowering cycles may be determined. The steps 1002 to 1012 may then repeated for the subsequent lowering cycles.

After one or more of the cycles have been analyzed as described in steps 1002 to 1012 the processor 304 may analyse the recorded data as described below in steps 1014 and 1016.

One method by which the processor 304 analyses the data is to identify trends in the viscous drag values, as shown by step 1014. There are many methods by which this may be done; however, in general, the processor looks for a series of consecutive lowering cycles for which the values are indicative of a consistently high or increasing level of viscous drag. For example, the processor 304 may calculate a rolling average of the viscous drag values for a given number of lowering cycles (such as 20, but any appropriate number may be used). In this way, the processor 304 is able to filter out minor variations, errors, and single anomalous lowering cycles which produce a high viscous drag value. As an alternative, regression analysis or similar techniques may be used to derive a trend for a series of data values. This analysis may similarly be performed on a rolling basis, using a set of data points.

In step 1016, the processor 304 may use the viscous drag values for one or more of the cycles, or use the calculated trends, to forecast downhole pressure waves. This may be done by using the determined values as an input to a model of the downhole conditions. The forecasting may be subsequently used to, for example, adjust the speed at which the casing is moved into or out of the well bore.

The viscous drag force can be very significant in wells with tight tolerance casing designs, i.e. large diameter casings being run inside existing casing with a narrow annulus. This is typical of well designs in deep water and HPHT (high pressure, high temperature) environments. The viscous drag force may be negligible for operations involving large annuli, e.g. when tripping drillpipe in large diameter holes.

Nevertheless, by determining a viscous drag value, from a plurality of measurements of the hookload taken over a cycle, the above method may be used to influence operational parameters during casing, liner and completion running operations.

It will be understood that the details in the above description are exemplary, and that the skilled person, with the benefit of data acquired from a number of rigs from a number of operations in which tubular members are moved within a wellbore, will be able to refine the criteria for identifying static friction, and furthermore be able to accurately assess the risk of a stuck pipe condition occurring. Such refinements will be within the remit of trial and error and therefore will not extend beyond the scope of the invention.

It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims. The features of the claims may be combined in combinations other than those specified in the claims.

The invention claimed is:

1. A system for identifying a force on a member being moved within a well bore by a rig, the rig comprising a moveable unit to which the member is attached so as to be moved within the well bore, and slips for holding the member, wherein the member is moved in a plurality of cycles, each cycle comprising, in sequence, holding the member in the slips, releasing the slips such that the member moves within the well bore, and applying the slips such that the member is again held by the slips, and the rig comprises a measurement unit arranged to measure a force imparted by the member onto the moveable unit, and being arranged to output first data indicative of a plurality of load values, each data item of said first data being indicative of a said force measured at each of a plurality of points during a said cycle, the system comprising:

an interface arranged to receive data from the measurement unit; and a data processing system arranged, for each of a plurality of said cycles to:

identify a plurality of said load values from the received data, each load value corresponding to a different point in time in respect of the cycle;

determine second data indicative of a force on the member from the identified plurality of load values, wherein the force is friction between the well bore and the member;

determine a trend in the second data whereby to determine whether the force on the member is increasing; and compare said plurality of load values to a predicted load value, or to identify an average value from said plurality of load values and a minimum value from said plurality of load values and to compare said average value and said minimum value, whereby to determine said second data.

2. The system of claim 1, wherein the data processing system is arranged to determine a variation of the plurality of load values whereby to determine said second data.

3. The system of claim 1, wherein the data processing system is arranged to calculate a risk value indicative of the probability of the member becoming stuck in the well bore from said second data.

4. The system of claim 1, wherein the data processing system is arranged to:

identify a period of time in the loading cycle, the period being between the slips being released and the slips being applied; and identify a set of said load values corresponding to points in time during said identified period of time whereby to identify said plurality of said load values.

5. The system of claim 4, wherein the data processing system is arranged to detect a change in the load values between a level indicative of the member being held in the slips, and a level indicative of the member being supported by the moveable unit, whereby to identify said period of time.

6. The system of claim 1, wherein the data processing system is arranged to:

determine said second data for a plurality of said cycles; and determine, using said second data, whether a force on the member is increasing.

7. The system of claim 1, wherein the data processing system is arranged to determine a trend in the second data whereby to determine whether a force on the member is increasing.

8. A method for identifying a force on a member being moved within a well bore by a rig, the rig comprising a moveable unit to which the member is attached so as to be moved within the well bore, and slips for holding the member, wherein the member is moved in a plurality of cycles, each cycle comprising holding the member in the slips, releasing the slips such that the member into moves within the well bore, and applying the slips such that the member is again held by the slips, and the rig comprises a measurement unit arranged to measure a force imparted by the member onto the moveable unit, and being arranged to output first data indicative of a plurality of load values, each data item of said first data being indicative of a said force measured at each of a plurality of points during a said cycle, the method comprising:

receiving data from the measurement unit; and for each of a plurality of said cycles:

identifying a plurality of said load values from the received data, each load value corresponding to a different point in time in respect of the cycle;

determining second data indicative of a force on the member from the identified plurality of load values, wherein the force is fiction between the well bore and the member;

determining a trend in the second data whereby to determine whether the force on the member is increasing; and comparing said plurality of load values to a predicted load value, or identifying an average value from said plurality of load values and a minimum value from said plurality of load values and comparing said average value and said minimum value, whereby to determine said second data.

9. The method of claim 8, comprising determining a variation of the plurality of load values whereby to determine said second data.

10. The method of claim 9, comprising calculating a risk value indicative of the probability of the member becoming stuck in the well bore from said second data.

11. The method of claim 9, comprising:

identifying a period of time in the loading cycle, the period being between the slips being released and the slips being applied; and identifying a set of said load values corresponding to points in time during said identified period of time whereby to identify said plurality of said load values.

12. The method of claim 11, comprising detecting a change in the load values between a level indicative of the member being held in the slips, and a level indicative of the member being supported by the moveable unit, whereby to identify said period of time.

13. The method of claim 8, comprising:

determining said second data for a plurality of said cycles; and determining, using said second data, whether a force on the member is increasing.

14. The method of claim 8, comprising determining a trend in the second data whereby to determine whether a force on the member is increasing.

15. A non-transitory computer readable storage medium storing computer readable instructions thereon for execution on a computing system to implement a method for identifying a force on a member being moved within a well bore by a rig, the rig comprising a moveable unit to which the member is attached so as to be moved within the well bore, and slips for holding the member, wherein the member is moved in a plurality of cycles, each cycle comprising holding the member in the slips, releasing the slips such that the member into moves within the well bore, and applying the slips such that the member is again held by the slips, and the rig comprises a measurement unit arranged to measure a force imparted by the member onto the moveable unit, and being arranged to output first data indicative of a plurality of load values, each data item of said first data being indicative of a said force measured at each of a plurality of points during a said cycle, the method comprising:

receiving data from the measurement unit; and for each of a plurality of said cycles:

identifying a plurality of said load values from the received data, each load value corresponding to a different point in time in respect of the cycle;

determining second data indicative of a force on the member from the identified plurality of load values, wherein the force is friction between the well bore and the member;

determining a trend in the second data whereby to determine whether the force on the member is increasing;

comparing said plurality of load values to a predicted load value, or identifying an average value from said plurality of load values and a minimum value from said plurality of load values and comparing said average value and said minimum value, whereby to determine said second data.

16. The computer readable storage medium of claim 15, wherein the method comprises determining a variation of the plurality of load values whereby to determine said second data.

17. The computer readable storage medium of claim 16, wherein the method comprises calculating a risk value indicative of the probability of the member becoming stuck in the well bore from said second data.

18. The computer readable storage medium of claim 16, wherein the method comprises:

identifying a period of time in the loading cycle, the period being between the slips being released and the slips being applied; and identifying a set of said load values corresponding to points in time during said identified period of time whereby to identify said plurality of said load values.

19. The computer readable storage medium of claim 18, wherein the method comprises detecting a change in the load values between a level indicative of the member being held in the slips, and a level indicative of the member being supported by the moveable unit, whereby to identify said period of time.

20. The computer readable storage medium of claim 15, wherein the method comprises:

determining said second data for a plurality of said cycles; and determining, using said second data, whether a force on the member is increasing.

21. The computer readable storage medium of claim 15, wherein the method comprises determining a trend in the second data whereby to determine whether a force on the member is increasing.

* * * * *